US009267365B2

(12) United States Patent
Dittmer et al.

(10) Patent No.: US 9,267,365 B2
(45) Date of Patent: Feb. 23, 2016

(54) APPARATUS FOR HEATING A HYDROCARBON RESOURCE IN A SUBTERRANEAN FORMATION PROVIDING AN ADJUSTABLE LIQUID COOLANT AND RELATED METHODS

(71) Applicant: HARRIS CORPORATION, Melbourne, FL (US)

(72) Inventors: Tim Dittmer, Viera, FL (US); Brian Wright, Indialantic, FL (US); Verlin A Hibner, Melbourne Beach, FL (US); Mark A Trautman, Melbourne, FL (US)

(73) Assignee: HARRIS CORPORATION, Melbourne, FL (US)

( * ) Notice: Subject to any disclaimer, the term of this patent is extended or adjusted under 35 U.S.C. 154(b) by 387 days.

(21) Appl. No.: 13/756,737

(22) Filed: Feb. 1, 2013

(65) Prior Publication Data

US 2014/0216725 A1 Aug. 7, 2014

(51) Int. Cl.

| | |
|---|---|
| ***E21B 34/04*** | (2006.01) |
| ***E21B 43/24*** | (2006.01) |
| ***E21B 36/00*** | (2006.01) |

(52) U.S. Cl.

CPC ..... *E21B 43/2401* (2013.01); *E21B 36/001* (2013.01); *H05B 2214/03* (2013.01)

(58) Field of Classification Search

CPC ..... E21B 36/00; E21B 36/001; E21B 36/005; E21B 36/04; E21B 43/2401

See application file for complete search history.

(56) References Cited

U.S. PATENT DOCUMENTS

| | | | | |
|---|---|---|---|---|
| 4,583,589 | A | 4/1986 | Kasevich | |
| 5,189,434 | A | 2/1993 | Bell | |
| 5,829,519 | A * | 11/1998 | Uthe | 166/60 |
| 6,009,318 | A | 12/1999 | Freed | |
| 6,565,127 | B2 | 5/2003 | Webb et al. | |
| 6,636,414 | B2 | 10/2003 | Obert et al. | |
| 6,870,439 | B2 | 3/2005 | Brown et al. | |
| 6,894,583 | B2 | 5/2005 | Brown et al. | |
| 6,930,568 | B2 * | 8/2005 | Snyder et al. | 333/156 |
| 7,059,428 | B2 | 6/2006 | Frey et al. | |
| 7,239,286 | B1 | 7/2007 | Miller et al. | |

(Continued)

FOREIGN PATENT DOCUMENTS

CA 1001550 12/1976

OTHER PUBLICATIONS

Farr et al "Design Considerations for Ultra-Wideband, High-Voltage Baluns" Sep. 1997.

Bridges et al., "In Situ RF Heating for Oil Sand and Heavy-Oil Deposits," IIT Research Institute, Chicago, Illinois, May 1985, pp. 1-11 (13 total pages).

(Continued)

*Primary Examiner* — Brad Harcourt

(74) *Attorney, Agent, or Firm* — Allen, Dyer, Doppelt, Milbrath & Gilchrist, P.A.

(57) ABSTRACT

An apparatus is provided for heating a hydrocarbon resource in a subterranean formation having a wellbore extending therein. The apparatus includes a radio frequency (RF) source, an RE antenna configured to be positioned within the wellbore, and an RF transmission line configured to be positioned within the wellbore and couple the RE source to the RE antenna. The RE transmission line defines a liquid coolant circuit therethrough. The apparatus further includes a liquid coolant source configured to be coupled to the transmission line and to provide a liquid coolant through the liquid coolant circuit having an electrical parameter that is adjustable.

18 Claims, 15 Drawing Sheets

(56) References Cited

U.S. PATENT DOCUMENTS

| | | | |
|---|---|---|---|
| 7,441,597 | B2 | 10/2008 | Kasevich |
| 7,453,328 | B2 | 11/2008 | Jue |
| 7,639,199 | B2 | 12/2009 | Rofougaran |
| 7,646,267 | B1 | 1/2010 | Tsironis |
| 7,891,421 | B2 | 2/2011 | Kasevich |
| 7,893,888 | B2 | 2/2011 | Roufougaran |
| 7,979,043 | B2 | 7/2011 | Roufougaran |
| 2010/0078163 | A1 | 4/2010 | Banerjee et al. |
| 2010/0294488 | A1 | 11/2010 | Wheeler et al. |
| 2010/0294489 | A1 | 11/2010 | Dreher, Jr. et al. |

OTHER PUBLICATIONS da Mata et al., "An Overview of the RF Heating Process in the Petroleum Industry," Department of Electrical Engineering—Federal University of Rio Grande do Norte, Brazil, SBMO/IEEE MTT-S IMOC '97 Proceedings, 1997, pp. 28-33.

Dittmer et al. U.S. Appl. No. 13/7676,449, filed Nov. 14, 2012.

Dittmer et al. U.S. Appl. No. 13/756,774, filed Feb. 1, 2013.

Dittmer et al. U.S. Appl. No. 13/756,707, filed Feb. 1, 2013.

Dittmer et al. U.S. Appl. No. 13/756,756, filed Feb. 1, 2013.

* cited by examiner

APPARATUS FOR HEATING A HYDROCARBON RESOURCE IN A SUBTERRANEAN FORMATION PROVIDING AN ADJUSTABLE LIQUID COOLANT AND RELATED METHODS

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RE energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Moreover, despite the existence of systems that utilize RF energy to provide heating, such systems may suffer from inefficiencies as a result of impedance mismatches between the RE source, transmission line, and/or antenna. These mismatches become particularly acute with increased heating of the subterranean formation. Moreover, such applications may require high power levels that result in relatively high transmission line temperatures that may result in transmission failures. This may also cause problems with thermal expansion as different materials may expand differently, which may render it difficult to maintain electrical and fluidic interconnections.

SUMMARY OF THE INVENTION

It is therefore an object of the invention to provide enhanced operating characteristics with RE heating for hydrocarbon resource recovery systems and related methods.

These and other objects, features, and advantages are provided by an apparatus for heating a hydrocarbon resource in a subterranean formation having a wellbore extending therein. The apparatus includes a radio frequency (RE) source, an RF antenna configured to be positioned within the wellbore, and an RF transmission line configured to be positioned within the wellbore and couple the RE source to the RF antenna. The RE transmission line defines a liquid coolant circuit therethrough. The apparatus further includes a liquid coolant source configured to be coupled to the transmission line and to provide a liquid coolant through the liquid coolant circuit, where the liquid coolant has an electrical parameter that is adjustable. As such, the electrical parameter may advantageously be adjusted to provide enhanced performance as operating characteristics of the RE antenna change during the heating process.

More particularly, the liquid coolant source further includes a liquid pump and a heat exchanger coupled in fluid communication therewith. Furthermore, the liquid coolant source also includes a plurality of liquid coolant reservoirs for respective different liquid coolants having different values of the electrical parameter, and a mixer for adjustably mixing the different liquid coolants to adjust the electrical parameter. The apparatus further includes a controller coupled to the mixer, and the controller may be responsive to a changing impedance of the transmission line. The controller may also include a communications interface configured to provide remote access via a communications network.

The electrical parameter that is adjustable may comprise a dielectric constant. Furthermore, the dielectric constant may be adjustable over a range of about 2 to 5, for example. Also by way of example, the liquid coolant may comprise a mineral oil, silicon oil, ester-based oil, etc. In addition, the transmission line may include a coaxial RF transmission line comprising an inner tubular conductor, and an outer tubular conductor surrounding the inner tubular conductor.

A related method for heating a hydrocarbon resource in a subterranean formation having a wellbore extending therein is also provided. The method includes coupling an RF transmission line to an RF antenna and positioning the RF transmission line and RF antenna within the wellbore, where the RF transmission line defines a liquid coolant circuit therethrough. The method further includes supplying an RF signal to the transmission lined from an RF source, and circulating a liquid coolant having an electrical parameter that is adjustable from a liquid coolant source through the liquid coolant circuit.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
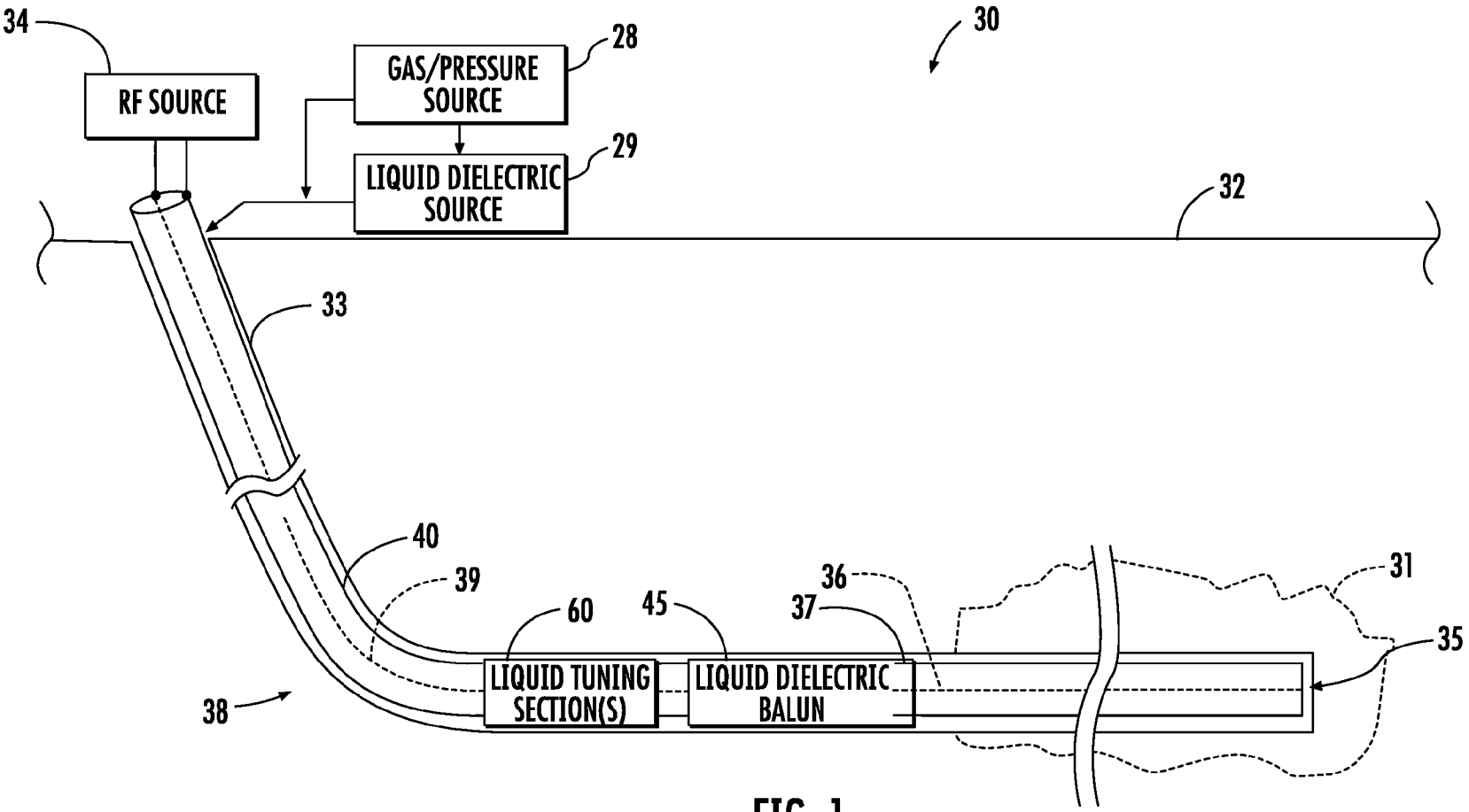
FIG. 1 is a schematic block diagram of an apparatus for heating a hydrocarbon resource in a subterranean formation in accordance with the present invention.

Referring initially to FIG. 1, an apparatus 30 for heating a hydrocarbon resource 31 (e.g., oil sands, etc.) in a subterranean formation 32 having a wellbore 33 therein is first described. In the illustrated example, the wellbore 33 is a laterally extending wellbore, although the system 30 may be used with vertical or other wellbores in different configurations. The system 30 further includes a radio frequency (RF) source 34 for an RF antenna or transducer 35 that is positioned in the wellbore 33 adjacent the hydrocarbon resource 31. The RF source 34 is positioned above the subterranean formation 32, and may be an RF power generator, for example. In an exemplary implementation, the laterally extending wellbore 33 may extend several hundred meters within the subterranean formation 32. Moreover, a typical laterally extending wellbore 33 may have a diameter of about fourteen inches or less, although larger wellbores may be used in some implementations. Although not shown, in some embodiments a second or producing wellbore may be used below the wellbore 33, such as would be found in a SAGD implementation, for collection of petroleum, etc., released from the subterranean formation 32 through heating.

A transmission line 38 extends within the wellbore 33 between the RF source 34 and the RF antenna 35. The RF antenna 35 includes an inner tubular conductor 36, an outer tubular conductor 37, and other electrical aspects which advantageously functions as a dipole antenna. As such, the RF source 34 may be used to differentially drive the RF antenna 35. That is, the RF antenna 35 may have a balanced design that may be driven from an unbalanced drive signal. Typical frequency range operation for a subterranean heating application may be in a range of about 100 kHz to 10 MHz, and at a power level of several megawatts, for example. However, it will be appreciated that other configurations and operating values may be used in different embodiments.

A dielectric may separate the inner tubular conductor 36 and the outer tubular conductor 37, and these conductors may be coaxial in some embodiments. However, it will be appreciated that other antenna configurations may be used in different embodiments. The outer tubular conductor 37 will typically be partially or completely exposed to radiate RF energy into the hydrocarbon resource 31.

The transmission line 38 may include a plurality of separate segments which are successively coupled together as the RF antenna 35 is pushed or fed down the wellbore 33. The transmission line 38 may also include an inner tubular conductor 39 and an outer tubular conductor 40, which may be separated by a dielectric material, for example. A dielectric may also surround the outer tubular conductor 40, if desired. In some configurations, the inner tubular conductor 39 and the outer tubular conductor 40 may be coaxial, although other transmission line conductor configurations may also be used in different embodiments.

The apparatus 30 further includes a balun 45 coupled to the transmission line 38 adjacent the RF antenna 35 within the wellbore. Generally speaking, the balun 45 is used for common-mode suppression of currents that result from feeding the RF antenna 35. More particularly, the balun 45 may be used to confine much of the current to the RF antenna 35, rather than allowing it to travel back up the outer conductor 40 of the transmission line, for example, to thereby help maintain volumetric heating in the desired location while enabling efficient, safe and electromagnetic interference (EMI) compliant operation.

Yet, implementation of a balun deep within a wellbore 33 adjacent the RF antenna 35 (e.g., several hundred meters down-hole), and without access once deployed, may be problematic for typical electrically or mechanically controlled baluns. Variable operating frequency is desirable to facilitate optimum power transfer to the RF antenna 35 and subterranean formation 32, which changes over time with heating. A quarter-wave type balun is well suited to the operating characteristics of the borehole RF antenna 35, due to the relatively high aspect ratio of length to diameter and relatively low loss, which results in enhanced system efficiency. However, such a configuration is also relatively narrow-band, meaning that it may require several adjustments over the life of the well, and the relatively high physical aspect ratio may also exacerbate voltage breakdown issues due to small radial spacing between conductors.

More particularly, several difficulties may be present when attempting to deploy a balun deep within the ground for a hydrocarbon heating application. While some balun configurations utilize a mechanical sliding short configuration to change impedance settings, given the relatively long wavelengths used for hydrocarbon heating, this may make it difficult to implement such a mechanical tuning configuration. That is, at typical wellbore dimensions and low frequency operation, the required travel distance of a sliding short to cover the desired operating range may be impractical. Moreover, this may also necessitate a relatively complex mechanical design to move the sliding short, which requires movement past electrical insulators and a motor that may be difficult to fit within the limited space constraints of the wellbore. Moreover, it becomes prohibitively expensive to significantly increase the dimensions of a typical wellbore and transmission line to accommodate such mechanical tuning features.

Figure 2:
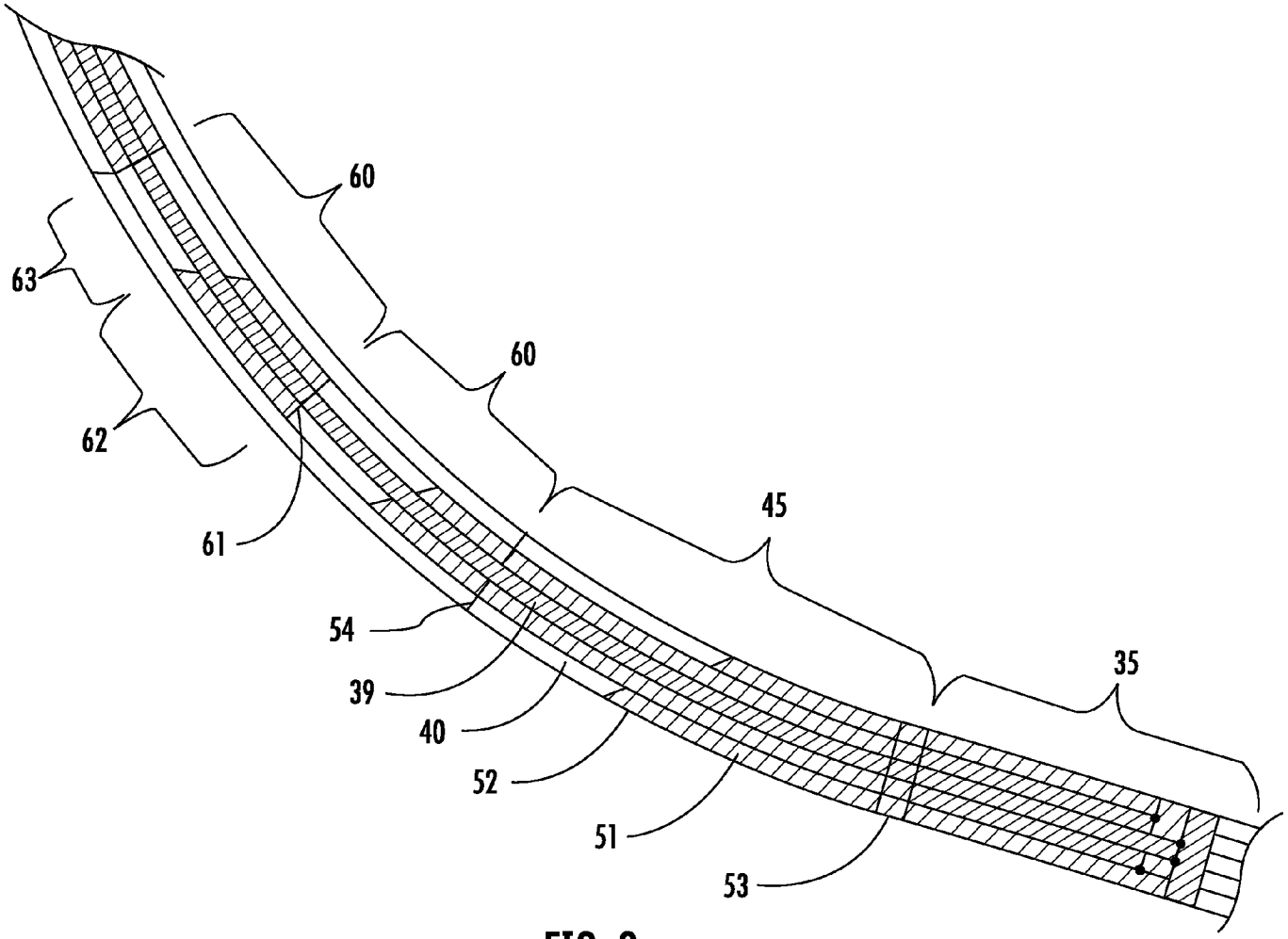
FIG. 2 is a schematic cross-sectional diagram showing the transmission line, liquid dielectric balun, and liquid tuning chambers from the apparatus of FIG. 1.
Figure 3:
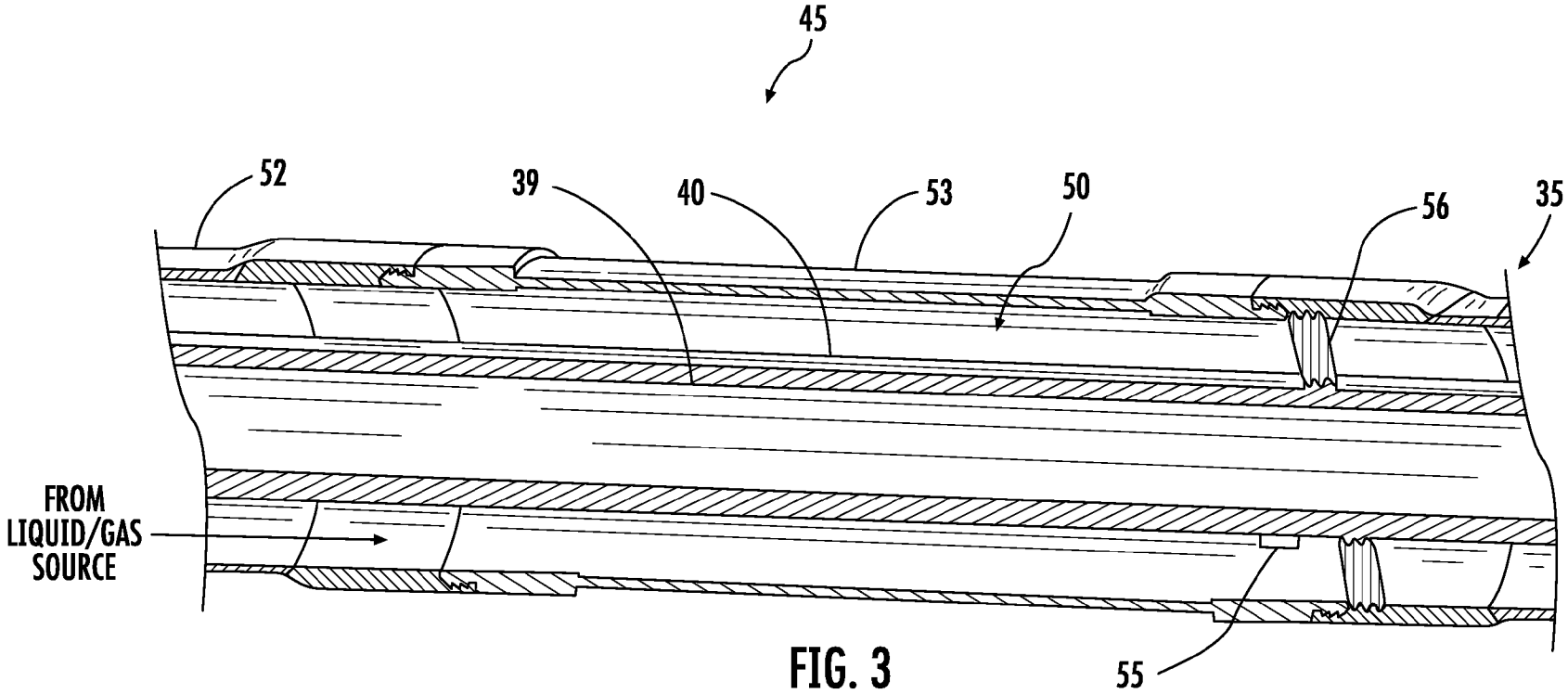
FIG. 3 is a cross-sectional perspective view of an embodiment of the balun from the apparatus of FIG. 1.

Turning additionally to FIGS. 2 and 3, rather than utilizing a mechanical tuning configuration such as a sliding short, the balun 45 advantageously comprises a body defining a liquid chamber 50 configured to receive a quantity of dielectric liquid 51 therein. Furthermore, the balun 45 may be configured to receive an adjustable or changeable quantity of dielectric liquid therein to advantageously provide adjustable frequency operation as the operating characteristics of the RF antenna 35 change during the heating process, requiring operation at the changing frequencies.

More particularly, the body of the balun 45 includes a tubular body surrounding the coaxial transmission line. The tubular body includes an electrically conductive portion 52 and an insulating portion 53 coupled longitudinally between the outer conductor 40 of the transmission line and the RF antenna 35. The insulating portion 53 may comprise a solid insulating material, although it may also comprise a non-solid insulator in some embodiments. Furthermore, one or more shorting conductors 54 (which may be implemented with an annular conductive ring having a fluid opening(s) therethrough) are electrically coupled between the electrically conductive portion 52 and the coaxial transmission line 38, and more particularly the outer conductor 40 of the coaxial transmission line. The electrically conductive portion 52 may serve as a cladding or protective outer housing for the transmission line 38, and will typically comprise a metal (e.g., steel, etc.) that is sufficiently rigid to allow the transmission line to be pushed down into the wellbore 33. The insulating portion may comprise a dielectric material, such as a high-temperature composite material, which is also sufficiently rigid to withstand pushing down into the wellbore and elevated heat levels, although other suitable insulator materials may also be used. Alternate embodiments may also utilize a fluid or a gas to form this insulator.

As will be discussed further below, in some embodiments the space within the inner conductor 39 defines a first passageway (e.g., a supply passageway) of a dielectric liquid circuit, and the space between the inner conductor and the outer conductor 40 defines a second passageway (e.g., a return passageway) of a dielectric liquid circuit. The dielectric liquid circuit allows a fluid (e.g., a liquid such as mineral oil, silicon oil, de-ionized water, ester-based oil, etc.) to be circulated through the coaxial transmission line 38. This fluid may serve multiple functions, including to keep the transmission line within desired operating temperature ranges, since excessive heating of the transmission line may otherwise occur given the relatively high power used for supplying the RF antenna 35 and the temperature of the hydrocarbon reservoir. Another function of this fluid may be to enhance the high-voltage breakdown characteristics of the coaxial structures, including the balun. With the availability of the liquid circuit, the balun 45 advantageously further includes one or more valves 55 for selectively communicating the dielectric liquid 51 from the liquid chamber 50 in the fluid circuit (e.g., the return passageway). This advantageously allows the liquid 51 to be evacuated from the liquid chamber 50 as needed. By way of example, the valve 55 may comprise a pressure-actuated valve, and the apparatus 30 may further include a pressure (e.g., gas) source 28 coupled in fluid communication with the liquid dielectric, to actuate the value as necessary. For example, the gas source 28 may be a nitrogen or other suitable gas source with a relatively low permittivity (Er) value, which causes heavier fluid to escape via the valve 55. An alternate embodiment may utilize an orifice in place of the valve, and dynamic adjustment of gas pressure from the surface to vary the liquid level in the liquid chamber 50.

The liquid chamber 50 is defined by a liquid-blocking plug 56 positioned adjacent an end of the liquid chamber and separating the balun 45 from the RF antenna 35. That is, the liquid-blocking plug 56 keeps the dielectric fluid 51 within the liquid chamber 50 and out of the RF antenna 35, and defines the "bottom" or distal end of the balun 45. A liquid dielectric source 29 (and optionally pressure/gas source) may supply the liquid chamber 50 via an annulus at the well head through the passageway defined between the electrically conductive portion 52 (i.e., outer casing) and the outer conductor 40. In some embodiments, another valve (not shown) is coupled between the inner conductor 39 and the outer conductor 40 to supply dielectric fluid from the cooling circuit (i.e., from the supply passageway) into the liquid chamber 50 as needed. Another approach is to run separate tubing between the outer conductor 40 and the casing (or external to the casing) for supplying or evacuating dielectric fluid to or from the liquid chamber 50. Generally speaking, it may be desirable to filter the dielectric liquid 51 or otherwise replace dielectric liquid in the liquid chamber with purified dielectric liquid to maintain desired operating characteristics.

Accordingly, the above-described configuration may advantageously be used to provide a relatively large-scale and adjustable quarter-wave balun with fixed mechanical dimensions, yet without the need for moving mechanical parts. Rather, the balun 45 may advantageously be tuned to desired resonant frequencies by using only an adjustable dielectric fluid level and gas, which may readily be controlled from the well head as needed. As such, this configuration advantageously helps avoid difficulties associated with implementing a sliding short or other mechanical tuning configuration in the relatively space-constrained and remote location within the wellbore 33. Moreover, use of the dielectric fluid helps to provide improved dielectric breakdown strength inside the balun 45 to allow for high-power operation.

Figure 4:
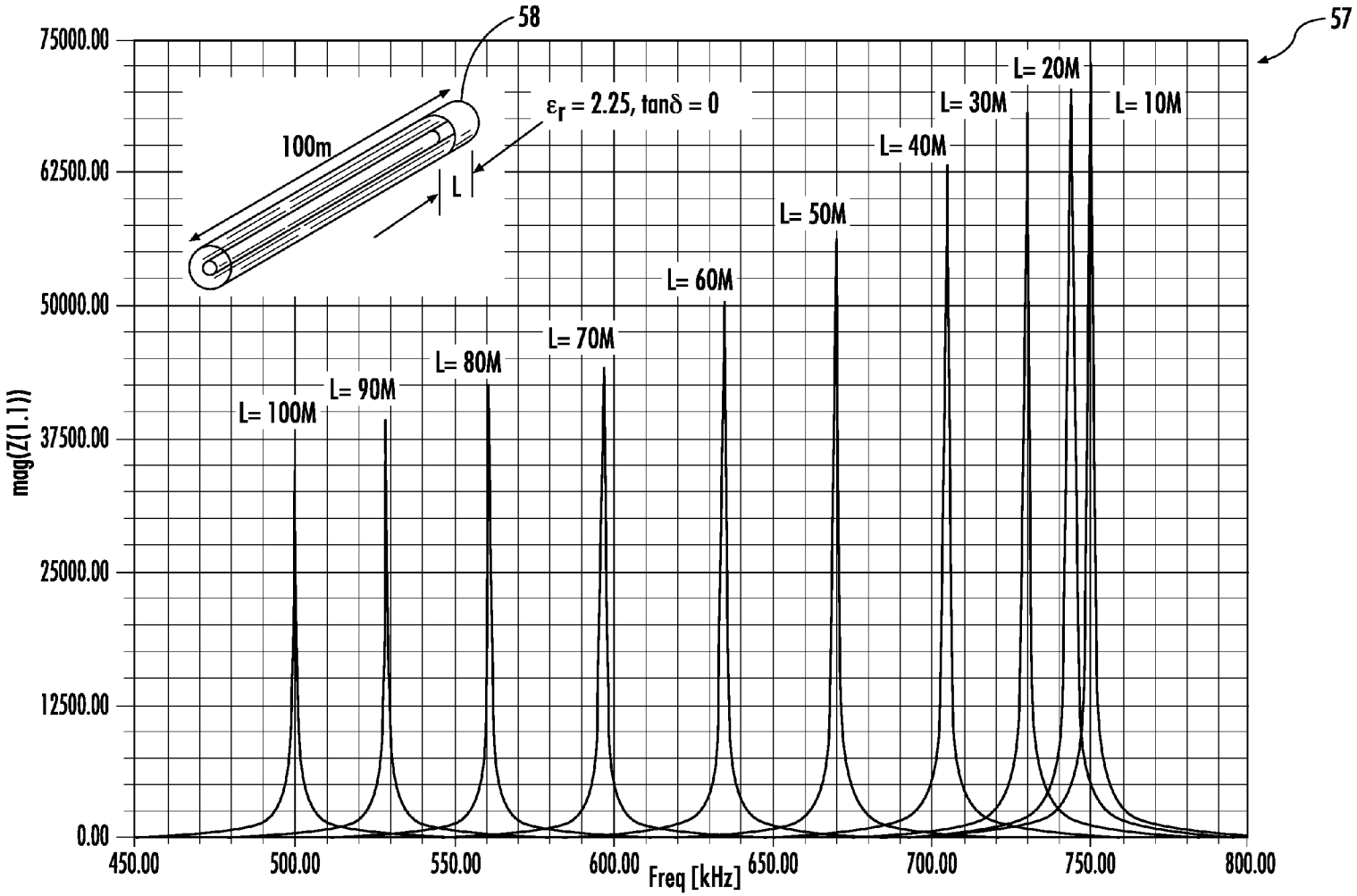
FIG. 4 is a graph of choking reactance and resonant frequency for the balun of FIG. 4 for different fluid levels.

Operation of the balun will be further understood with reference to the graph 57 of FIG. 4 showing simulated performance for a model liquid balun 58. In the illustrated example, a diameter of 3⅛ inch was used for the inner conductor, along with a diameter of ten inches for the outer conductor, which had a 0.1 inch wall thickness. An overall length of 100 m was used for the model balun 58, and the various reactance/frequency values for various fluid lengths ranging from 10 m to 100 m are shown. A dielectric fluid (i.e., mineral oil) with a Er of 2.25 and tan(d) of approximately 0 was used in the simulation.

It will be appreciated that the range of tunable bandwidth is proportional to the square root of relative permittivity as follows:

$$f_l = \frac{f_h}{\sqrt{\varepsilon_r}}$$

As will also be appreciated from the illustrated simulation results, a lossy dielectric lowers common mode impedance, and a lower characteristic impedance of the balun lowers common mode impedance (e.g., a smaller outer diameter of the outer conductor). A balun tuning range of Er~150% was advantageously achieved with the given test configuration, although different tuning ranges may be achieved with different configurations. As such, the balun 45 advantageously provides for enhanced performance of the RF antenna 35 by helping to block common mode currents along the outer conductor 40, for example, which also allows for targeted heating and compliance with surface radiation and safety requirements.

Figure 14:
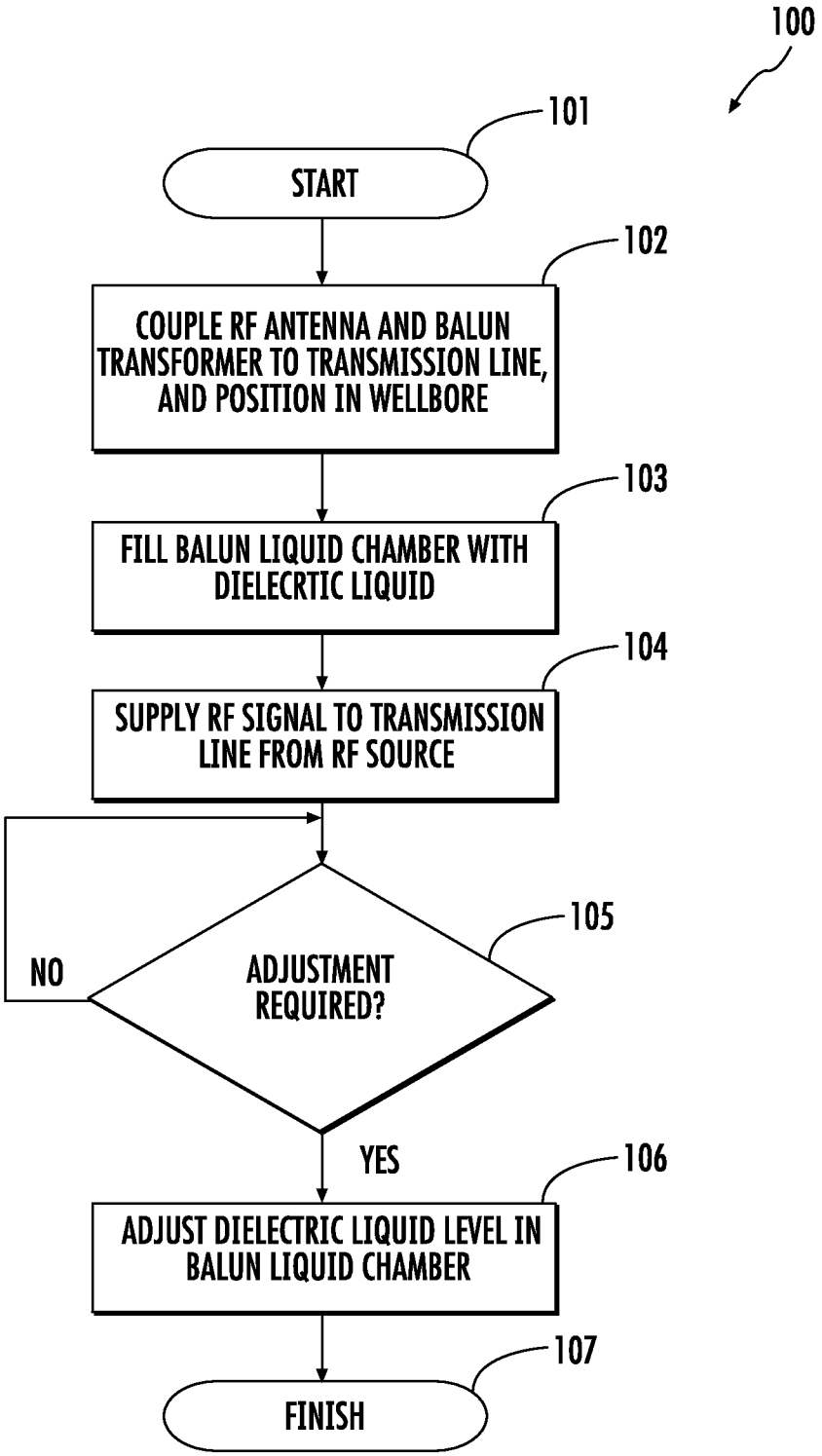
FIGS. 14-16 are flow diagrams illustrating method aspects associated with the apparatus of FIG. 1.

Exemplary installation and operational details will be further understood with reference to the flow diagram 100 of FIG. 14. Beginning at Block 101, the balun 45 is coupled or connected to the RF antenna 35, and the transmission line 38 is then coupled to the opposite end of the balun in segments as the assembled structure is fed down the wellbore 33, at Block 102. The liquid chamber 50 is then filled using one of the approaches described above to a desired starting operating level, and heating may commence by supplying the RF signal to the transmission line from the RF source 34, at Blocks 103, 104. It should be noted that the liquid chamber 50 need not necessarily be filled before heating commences, in some embodiments.

Over the service life of the well (which may last several years), measurements may be taken (e.g., impedance, common mode current, etc.) to determine when changes to the fluid level are appropriate, at Blocks 105-106, to conclude the method illustrated in FIG. 14 (Block 107). That is, a reference index or database of expected operating values for different fluid levels, such as those shown in FIG. 4, may be used to determine an appropriate new dielectric fluid level to provide desired operating characteristics, either by manual configuration or a computer-implemented controller to change the fluid levels appropriately. The dielectric fluid may also be filtered or replaced as necessary to maintain desired operating characteristics as well, as described above.

Referring additionally to FIGS. 5 through 9, additional tuning adjustments may be provided in some embodiments through the use of liquid tuning sections 60 included within the coaxial transmission line 38. More particularly, in the example of FIG. 2, the transmission line 38 illustratively includes two tuning sections 60, although a single tuning section or more than two tuning sections may be used in different embodiments. Each tuning section 60 includes the inner conductor 39, the outer conductor 40 surrounding the inner conductor, and a liquid-blocking plug 61 between the inner and outer conductors to define a tuning chamber configured to receive a dielectric liquid 62 with a gas headspace 63 thereabove. Thus, via adjustable liquid level, the liquid tuning sections 60 may advantageously be used to match the impedance of the antenna to the source of RF power, as operating characteristics of the RF antenna change during the heating process.

Figure 5:
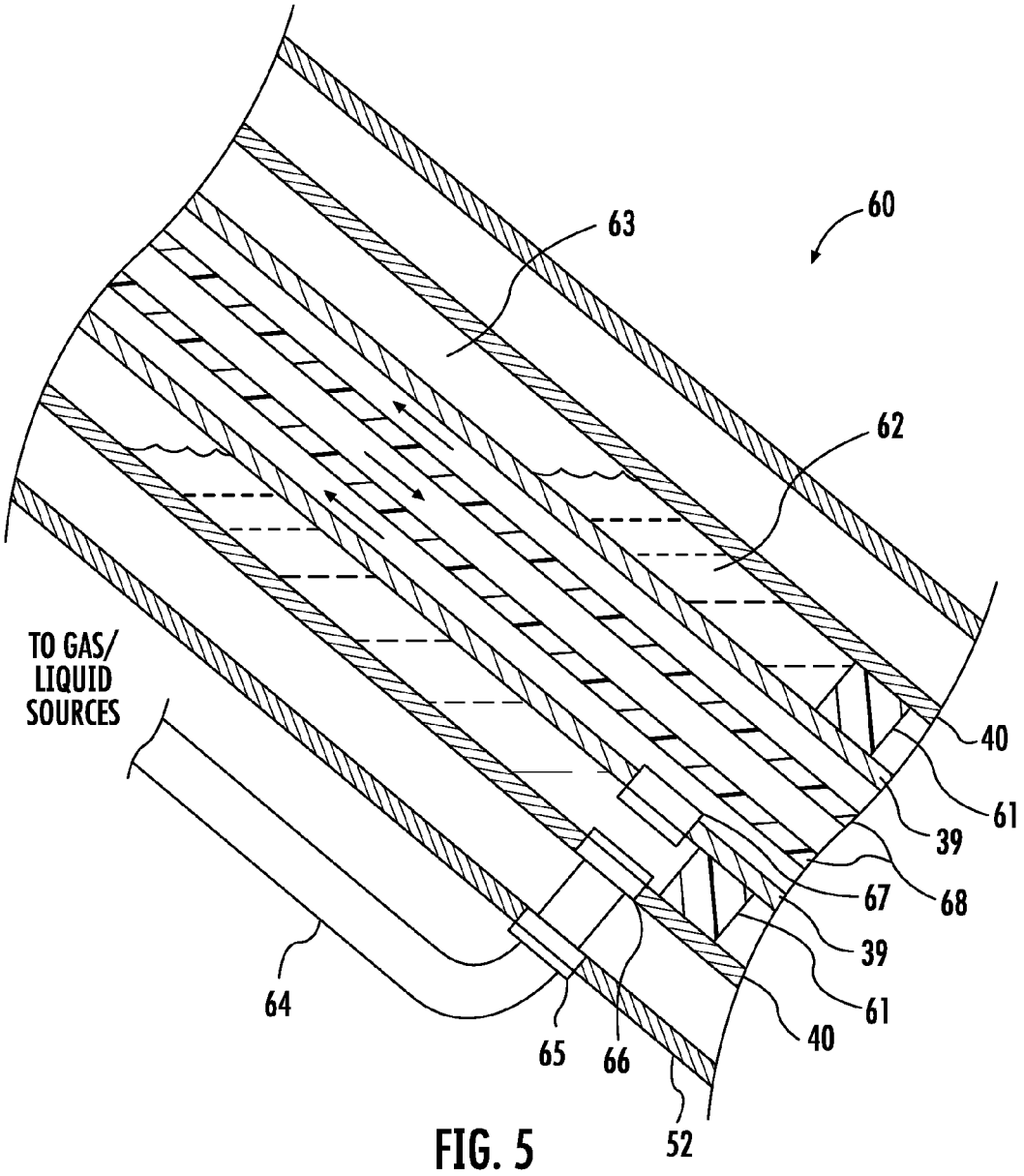
FIG. 5 is a schematic cross-sectional view of an embodiment of the lower end of the balun of FIG. 2, showing an approach for adding/removing fluids and/or gasses therefrom.

More particularly, gas and liquid sources may be coupled in fluid communication with the tuning section 60 so that a level of the liquid dielectric 62 relative to the gas headspace 63 is adjustable. In the example of FIG. 5, an external line 64 (e.g., a dielectric tube) may be adjacent the transmission line and coupled in fluid communication with the tuning chamber. Here, fluid coupling ports 65, 66 connect the external line 64 to the fluid tuning chamber through the outer cladding 52 and the outer conductor 40 as shown. It should be noted that in some embodiments the line 64 may be run between the cladding 52 and the outer conductor 40, rather than external to the conductor, if desired.

In the illustrated embodiment, a valve 67 (e.g., a pressure-actuated valve) is also included to allow evacuation of the dielectric fluid 62 from the tuning chamber into the cooling fluid circuit. Here, the cooling fluid circuit is included entirely within the inner conductor 39 by running a fluid line 68 inside the inner conductor. In this example, the fluid line 68 is used for fluid supply, while fluid return occurs through the remaining space within the inner conductor, but the fluid line 68 may instead be used for cooling fluid return in other embodiments, if desired. As described above, a similar valve may also be used to provide dielectric fluid from the cooling fluid circuit into the tuning chamber in some embodiments, although where an external line 64 is present it may be used to provide both liquid and gas supply and removal without the need for separate valves opening to the cooling fluid circuit. In some embodiments, a vaned annulus may be used at the well head to provide multiple fluid paths for the various fluid tuning chambers.

In some configurations, multiple remotely controlled valves may be used to reduce a number of requisite fluid passages. Remote control may be performed via a common fluid passageway, capable of unlocking one or more valves via a predetermined pressure pulse sequence, or via electrical signaling using a designated waveform, for example (e.g., modulation imposed upon RF excitation signal). Separately fed signals may be provided by parallel or serial bus cables, ESP cables, etc., included in the transmission line 38.

As noted above, as the subterranean formation 32 is heated, its complex electrical permittivity changes with time, changing the input impedance of the RE antenna 35. Additionally, as a direct-contact transducer, the RE antenna 35 may operate in two modes, namely a conductive mode and an electromagnetic mode, which leads to significantly different driving point impedances. The tuning sections 60 may advantageously allow for more efficient delivery of energy from the RE antenna 35 to the surrounding subterranean formation 32 by reducing reflected energy back up the transmission line 38.

The tuning sections 60 advantageously provide a physically linear, relatively high power tuner having a characteristic impedance ($_{ZO}$) which may be remotely adjustable via a variable level of the dielectric fluid 62 and the gas headspace 63. More particularly, the lower fluid portion of each tuning section 60 provides a low-Z tuning element (e.g., similar to a shunt capacitor), while the upper portion of each tuning section provides a high-Z tuning element (e.g., similar to a series inductor). The level of the dielectric fluid 62 determines the ratio of these lengths. Multiple tuning sections 60 may be coupled in series or cascaded to provide different tuning ranges as desired.

Other advantages of the tuning sections 60 are that their physical structure is linear and relatively simple mechanically, which may advantageously facilitate usage in hydrocarbon heating environments (e.g., oil sand recovery). Here again, this approach may provide significant flexibility in matching deep subsurface RF antenna impedances without the associated difficulties that may be encountered with mechanical tuning configurations.

Figure 6:
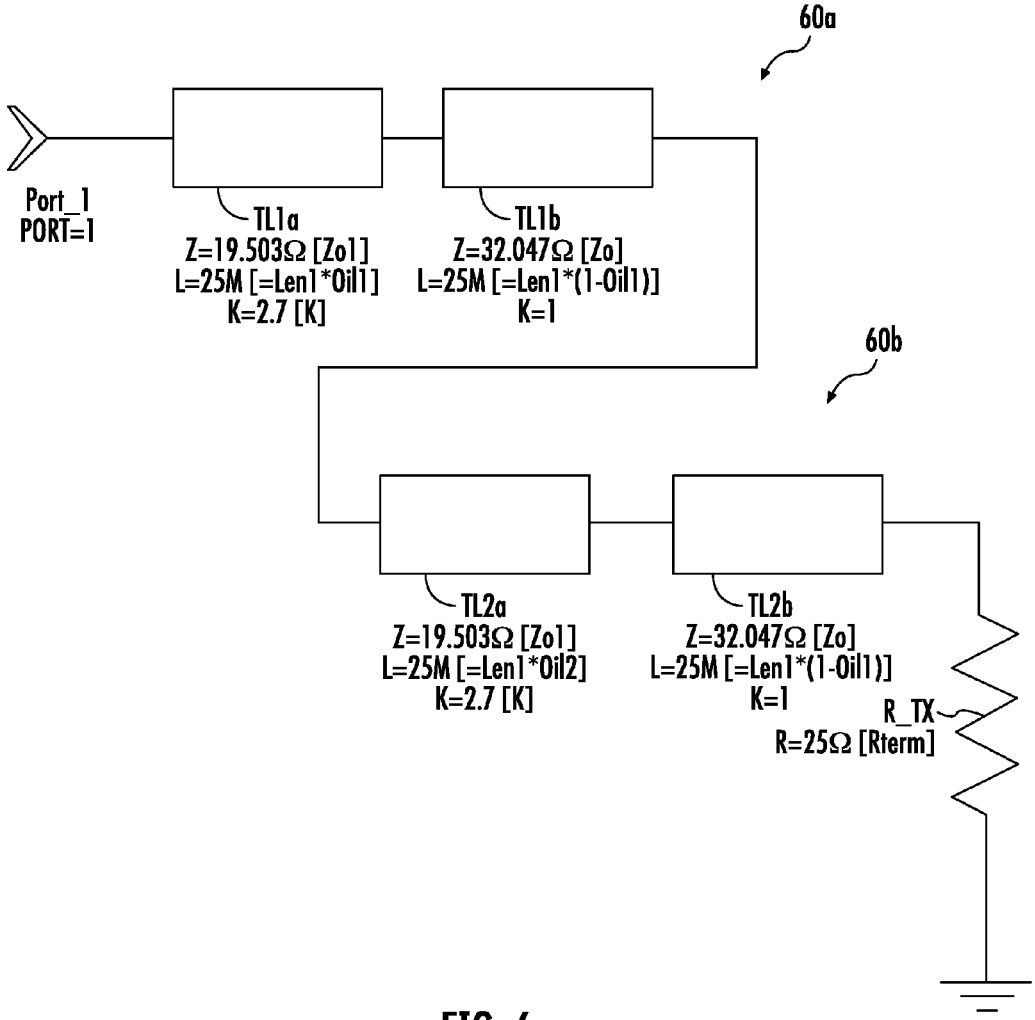
FIG. 6 is a schematic circuit representation of the balun of FIG. 2 which also includes a second balun.
Figure 7:
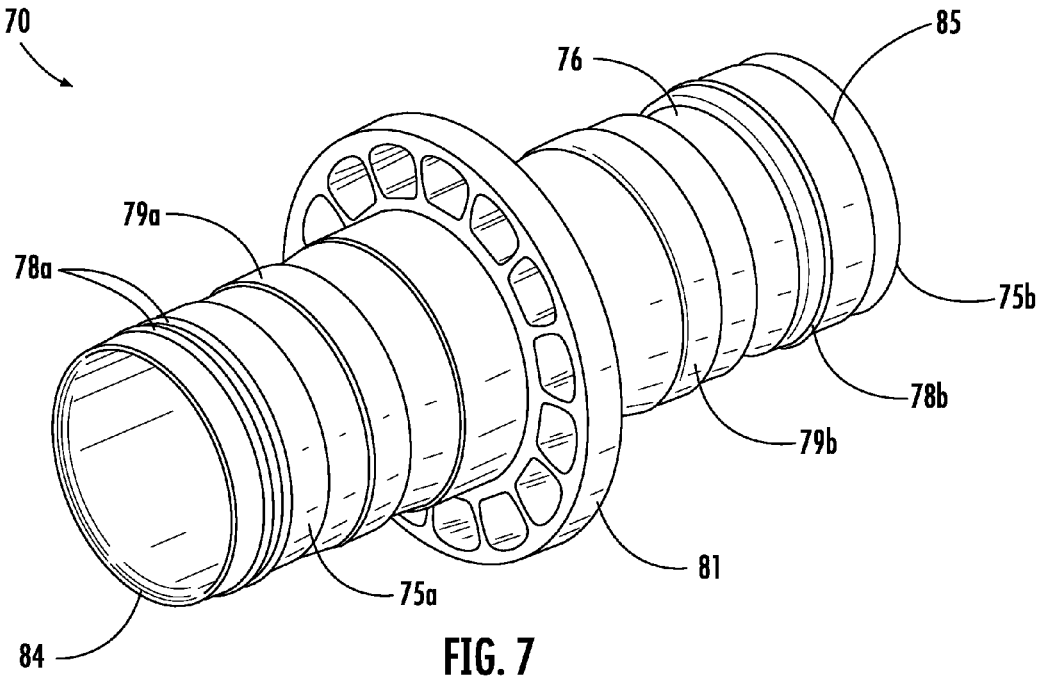
FIG. 7 is a perspective view of a transmission line segment coupler for use with the apparatus of FIG. 1.
Figure 8:
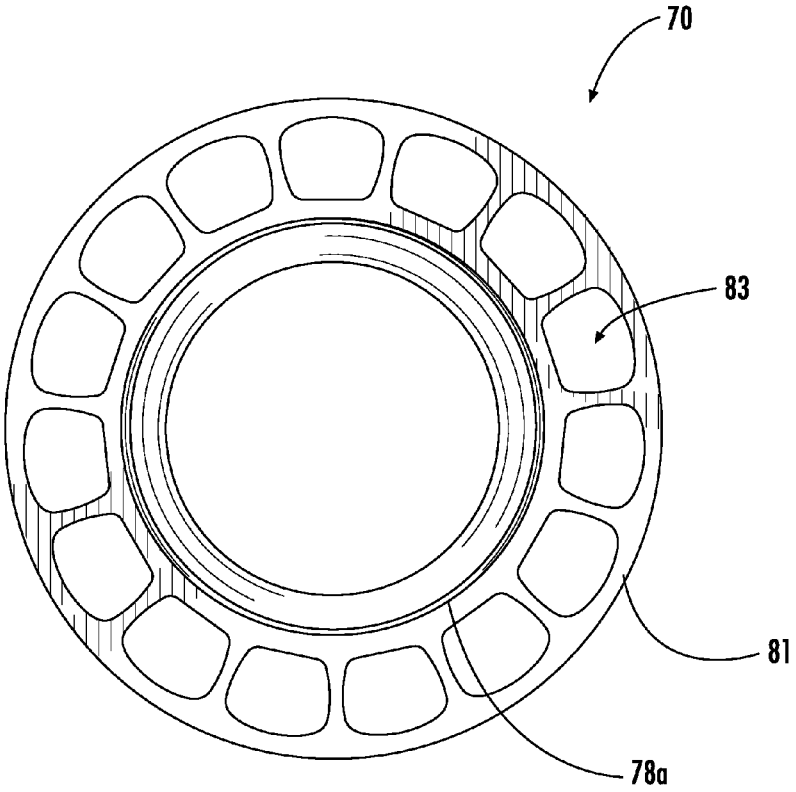
FIG. 8 is an end view of the transmission line segment coupler of FIG. 7.

Operational characteristics of the tuning sections 60 will be further understood with reference to the example implementation shown in FIG. 6, which is a schematic equivalent circuit for the series of two tuning sections shown in FIG. 2. More particularly, a first tuning section 60*a* includes a high-Z element (i.e., representing gas headspace 63) TL1*a*, and a low-Z element (i.e., representing liquid-filled section) TL1*b*. A second tuning section 60 similarly includes a high-Z element TL2*a* and a low-Z element TL2*b*. The RF source 34 is represented by a resistor R-TX, which in the illustrated configuration has a resistance value of 25 Ohms.

Figure 17:
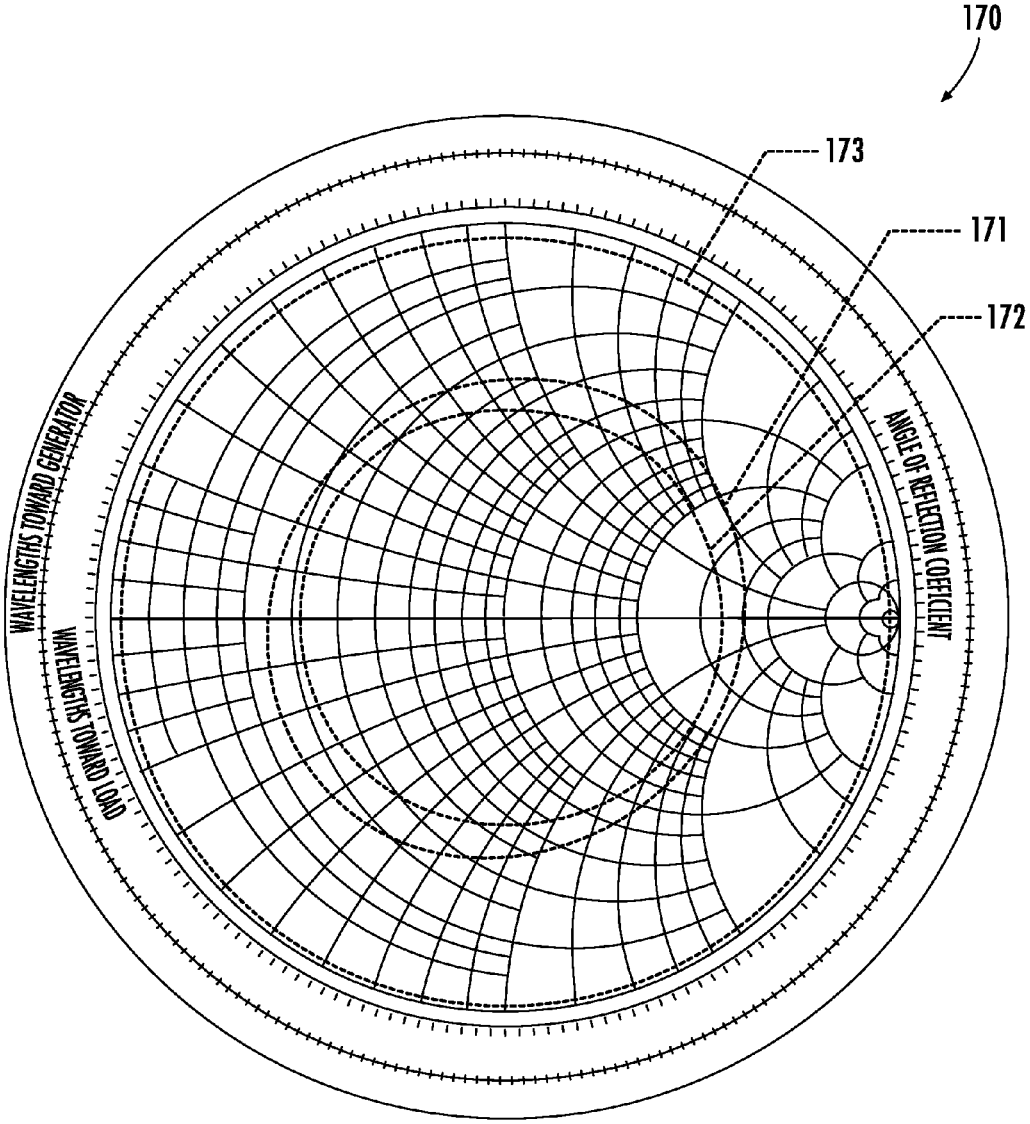
FIG. 17 is a Smith chart illustrating operating characteristics of various example liquid tuning chamber configurations of the apparatus of FIG. 1.

Results from a first simulation using the above described equivalent circuit elements are now described with reference to a Smith chart 170 shown in FIG. 17. For this simulation, an overall length of 50 m was used for each tuning section 60, along with a mineral oil having an Er of 2.7 for the dielectric liquid and air ($Z_0$=32 Ohms) as the headspace gas, and an operating frequency of 5 MHz was used. The value of R_TX was 25 Ohms, while a value of 22 Ohms was used to represent the RF antenna 35. This configuration advantageously provided matched tuning of antenna impedances at all phases of up to a 4:1 Voltage Standing Wave Ratio (VSWR), as shown by the region 171 in FIG. 17. Another similar simulation utilized an adjusted $Z_0$ value of 20 Ohms, and a value of 12 Ohms for the RF antenna 35. This configuration resulted in a simulated tuning range of up to approximately 3.4:1 VSWR for desired operational phases, as represented by the region 172. Still another simulation utilized a different dielectric fluid, namely de-ionized water with a Er of 80, a 30 m tuning section, an adjusted $Z_0$ of 70 Ohms, and an operating frequency of 1 MHz. Here, the simulation results indicate a VSWR range of approximately 24:1, as represented by the region 173. This represents a very high versatility and capability for the tuner configuration.

It will be appreciated that different dielectric fluids with different Er values may be used to trade tuning performance with other characteristics, such as voltage breakdown. Moreover, the tuning sections 60 may be of various lengths and impedances, and different numbers of tuning sections may be used in different embodiment, as well as fixed $Z_0$ transmission line segments interposed therebetween, if desired.

Figure 15:
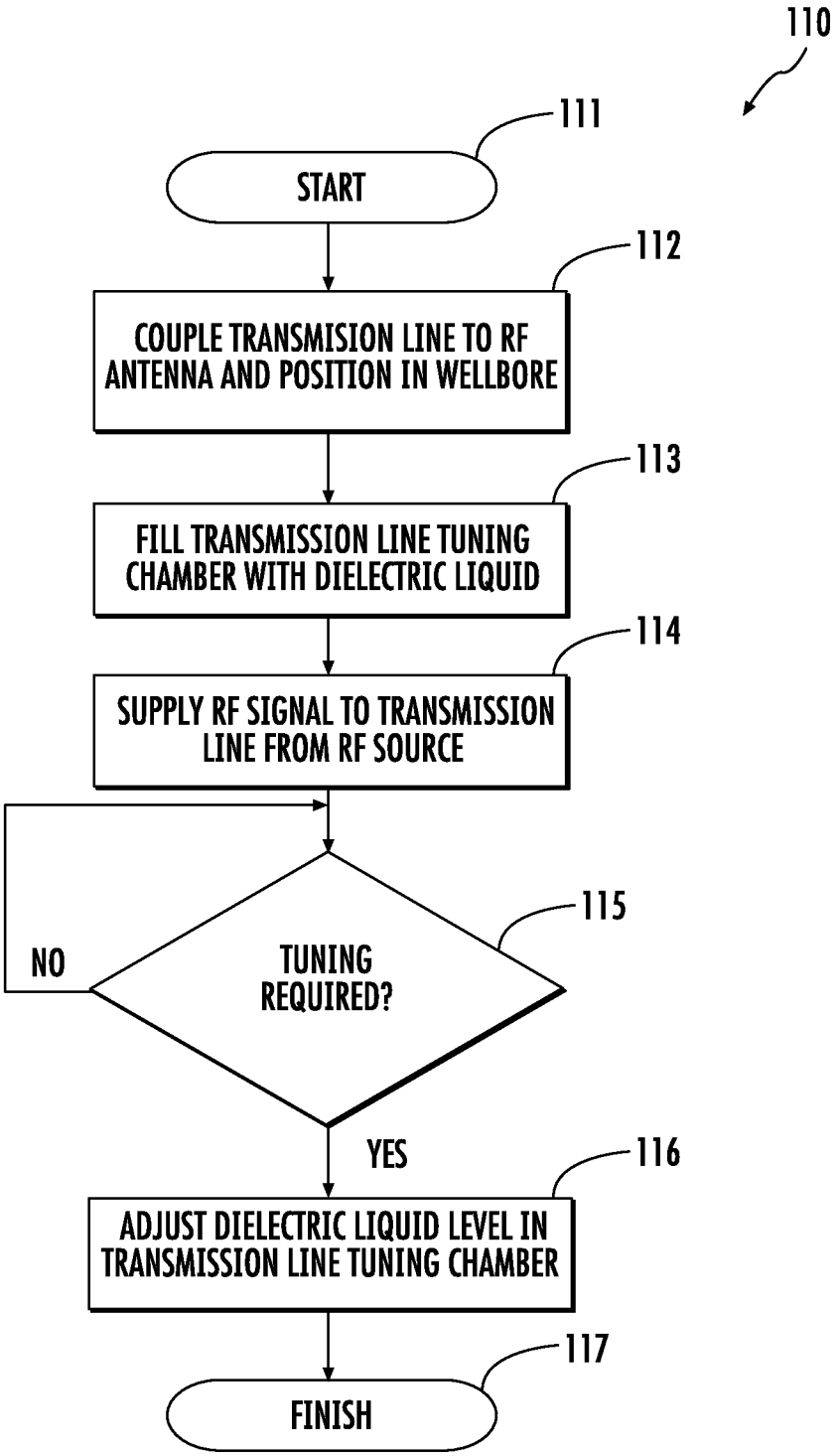

Exemplary installation and operational details associated with the tuning sections 60 will be further understood with reference to the flow diagram 110 of FIG. 15. Beginning at Block 111, one or more tuning sections 60 are coupled in series to the RF antenna 35 (as well as other tuning sections without liquid tuning chambers therein to define the transmission line 38), and the assembled structure is then fed down the wellbore 33, at Block 112. The above-described balun 45 may also be included in some embodiments, although the tuning segments and balun may be used individually as well. The tuning chamber may then be filled using one of the approaches described above to a desired ratio of liquid to gas headspace, and heating may commence by supplying the RF signal to the transmission line from the RF source 34, at Blocks 113, 114. It should be noted that the liquid chamber 50 need not necessarily be filled before heating commences, in some embodiments.

Measurements may be taken to determine when changes to the dielectric fluid levels/gas headspace are appropriate, at Blocks 115-116, to conclude the method illustrated in FIG. 15 (Block 117). Here again, a reference index or database of expected operating values for different liquid/gas ratios may be used to determine an appropriate new dielectric fluid level to provide desired operating characteristics, either by manual configuration or a computer-implemented controller to change the fluid levels appropriately. The dielectric fluid may also be filtered or replaced as necessary to maintain desired operating characteristics as well, as described above.

Turning now additionally to FIGS. 7-12, a transmission line segment coupler or "bullet" 70 for coupling together sections of a coaxial transmission line is now described. More particularly, the transmission line may be installed by coupling together a series of segments to grow the length of the transmission line as the RF antenna is fed deeper into the wellbore. Typical transmission line segments may be about twenty to forty feet in length, but other segment lengths may be used in different embodiments. The bullet 70 may be particularly useful for coupling together transmission line segments which define a cooling fluid circuit, as will be appreciated by those skilled in the art However, in some embodiments a linear bearing configuration similar to the one illustrated herein may be used to couple liquid timing sections or baluns, such as those described above.

The bullet 70 is configured to couple first and second coaxial transmission line segments 72*a*, 72*b*, each of which includes an inner tubular conductor 39*a* and an outer tubular conductor 40*a* surrounding the inner tubular conductor, as described above, and a dielectric therebetween. The bullet 70 includes an outer tubular bearing body 71 to be positioned within adjacent open ends 73*a*, 73*b* of the inner tubular conductors 39*a*, 39*b* of the first and second coaxial transmission line segments 72*a*, 72*b*, and an inner tubular bearing body 74 configured to slidably move within the outer tubular bearing body to define a linear bearing therewith. The inner tubular bearing body 74 is configured to define a fluid passageway in communication with the adjacent open ends 73*a*, 73*b* of the inner tubular conductors 39*a*, 39*b* of the first and second coaxial transmission line segments 72*a*, 72*b*.

More particularly, the inner tubular bearing body 74 includes opposing first and second ends 75*a*, 76*b* extending outwardly from the outer tubular bearing 71, and a medial portion 76 extending between the opposing first and second ends. The medial portion 76 of the inner tubular bearing body 74 has a length greater than the outer tubular bearing body 71 to define a linear bearing travel limit, which is defined by a gap 77 between the outer tubular bearing 71 and the second end 76*b* (see FIG. 10). More particularly, the gap 77 allows linear sliding play to accommodate section thermal expansion. By way of example, a gap 77 distance of about inch will generally provide adequate play for the operating temperatures (e.g., approximately 150° C. internal, 20° C. external at typical wellbore depths) and pressure levels (e.g., about 200 to 1200 PSI internal) experienced in a typical hydrocarbon heating implementation, although other gap distances may be used.

The bullet 70 further includes one or more respective sealing rings 78*a*, 78*b* (e.g., O-rings) carried on each of the first and second ends 75*a*, 76*b*. Furthermore, the first end 75*a* and the medial portion 76 may be threadably coupled together. In this regard, hole features 84 may be provided for torque-tool gripping, if desired. Also, the first end 75*a* is configured to be slidably received within the open end 73*a* of the tubular inner conductor 39*a* of the first coaxial transmission line segment 72*a*, and the second end 75*b* is configured to be fixed to the open end 73*b* of the tubular inner conductor 39*b* of the second coaxial transmission line segment 73*b*. More particularly, the second end 75*b* may have a crimping groove 84 therein in which the open end 73*b* of the tubular inner conductor 39*b* is crimped to provide a secure connection therebetween.

The bullet 70 further includes a respective electrically conductive spring 79*a*, 79*b* carried on each end of the outer tubular bearing body 71. The springs 79*a*, 79*b* are configured to engage a respective open end 73*a*, 73*b* of the respective inner tubular conductor 39*a*, 39*b* of the first and second coaxial transmission line segments 72*a*, 72*b*. More particularly, the outer tubular bearing body 71 may have a respective annular spring-receiving channel 80*a*, 80*b* on an outer surface thereof for each electrically conductive spring 39*a*, 39*b*. The illustrated springs 79*a*, 79*b* are of a "watchband-spring" ring type, which advantageously provide continuous electrical contact from the inner conductor 39*a* through the inner tubular bearing body 71 to the inner conductor 39*b*. However, other spring configurations (e.g., a "spring-finger" configuration) or electrical contacts biasable by a flexible member (e.g., a flexible O-ring, etc.) may also be used in different embodiments.

To provide enhanced electrical conductivity, the springs 79*a*, 79*b* may comprise beryllium, which also helps accommodate thermal expansion, although other suitable materials may also be used in different embodiments. The inner tubular bearing body 74 may comprise brass, for example, to provide enhanced current flow and wear resistance, for example, although other suitable materials may also be used in different embodiments. The first end 75*a* (or other portions of the inner tubular bearing body 74) may also be coated with nickel, gold, etc., if desired to provide enhanced performance. Similarly, the outer tubular bearing body 71 may also comprise brass, and may be coated as well with gold, etc., if desired. Here again, other suitable materials may be used in different embodiments.

Figure 10:
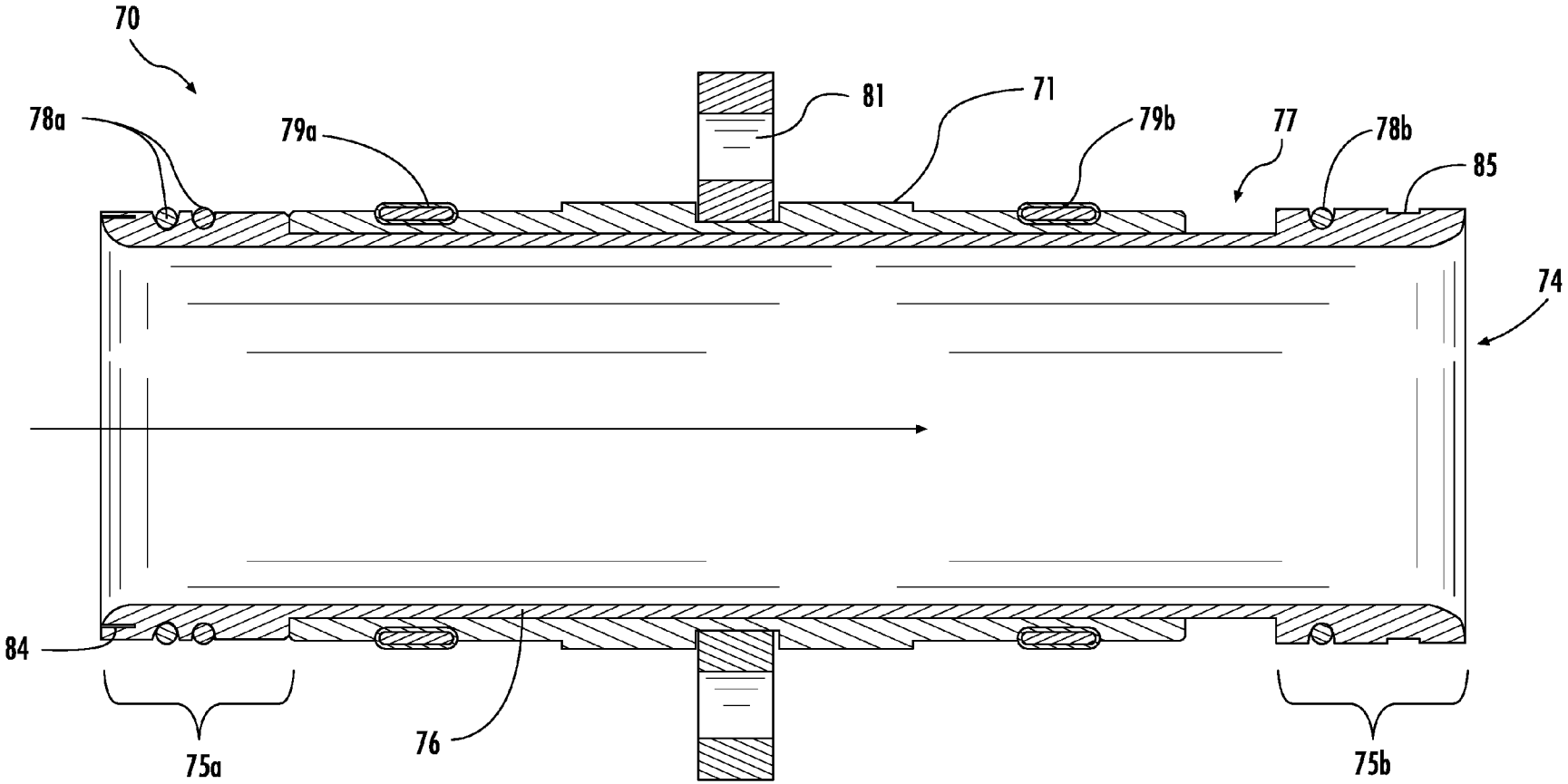
FIG. 10 is a cross-sectional view of the inner conductor transmission line segment coupler of FIG. 7.
Figure 11:
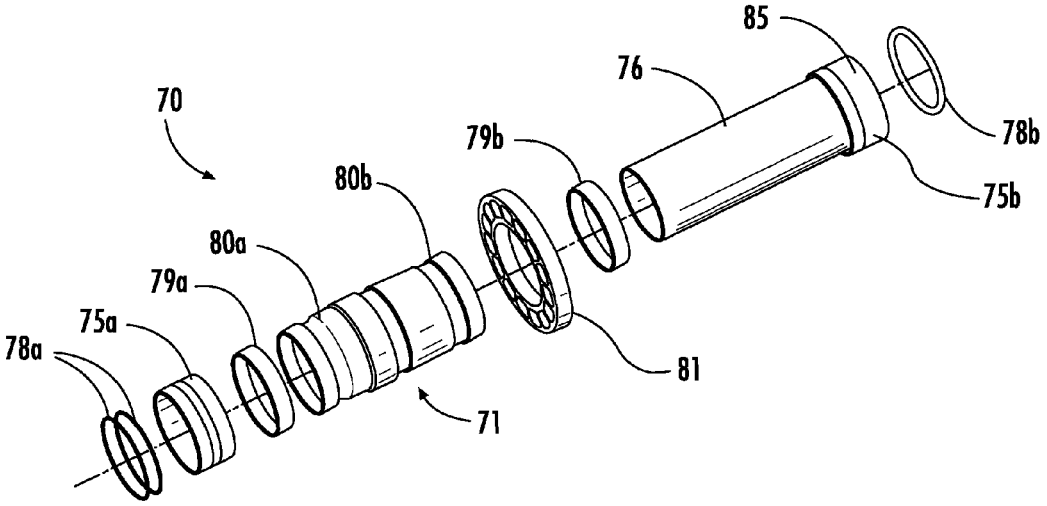
FIGS. 11 and 12 are fully exploded and partially exploded views of the transmission line segment coupler of FIG. 7, respectively.
Figure 12:
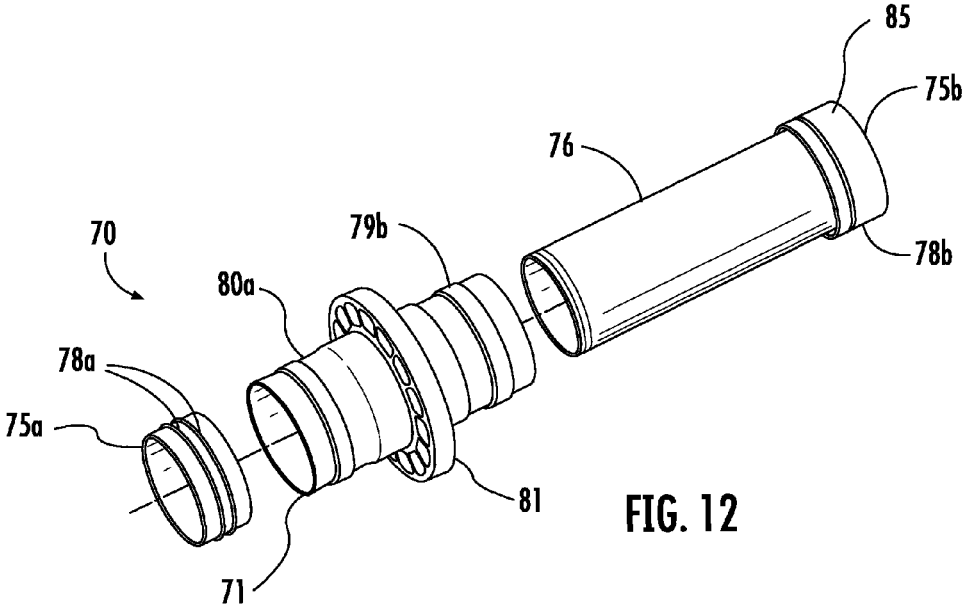

The bullet 70 further includes a dielectric support 81 for the outer tubular bearing body 71 within a joint 82 defined between adjacent tubular outer conductors 40*a*, 40*b* of the first and second coaxial transmission line segments 72*a*, 72*b*. In addition, the dielectric support 81 may have one or more fluid passageways 83 therethrough to permit passage of a dielectric cooling fluid, for example, as described above. As seen in FIG. 10, the dielectric support 81 sits or rests in a corresponding groove formed in the outer tubular bearing body 71.

As a result of the above-described structure, the bullet 70 advantageously provides a multi-function RF transmission line coaxial inner-coupler, which allows for dielectric fluid transport and isolation as well as differences in thermal expansion between the inner conductor 39 and the outer conductor 40. More particularly, while some coaxial inner couplers allow for some fluid transfer between different segments, such couplers generally do not provide for coefficient of thermal expansion (CTE) mismatch accommodation. This may become particularly problematic where the inner conductor 39 and the outer conductor 40 have different material compositions with different CTEs, and the transmission line is deployed in a high heat environment, such as a hydrocarbon resource heating application. For example, in a typical coaxial transmission line, the inner conductor 39 may comprise copper, while the outer conductor 40 comprises a different conductor, such as aluminum.

Figure 9:
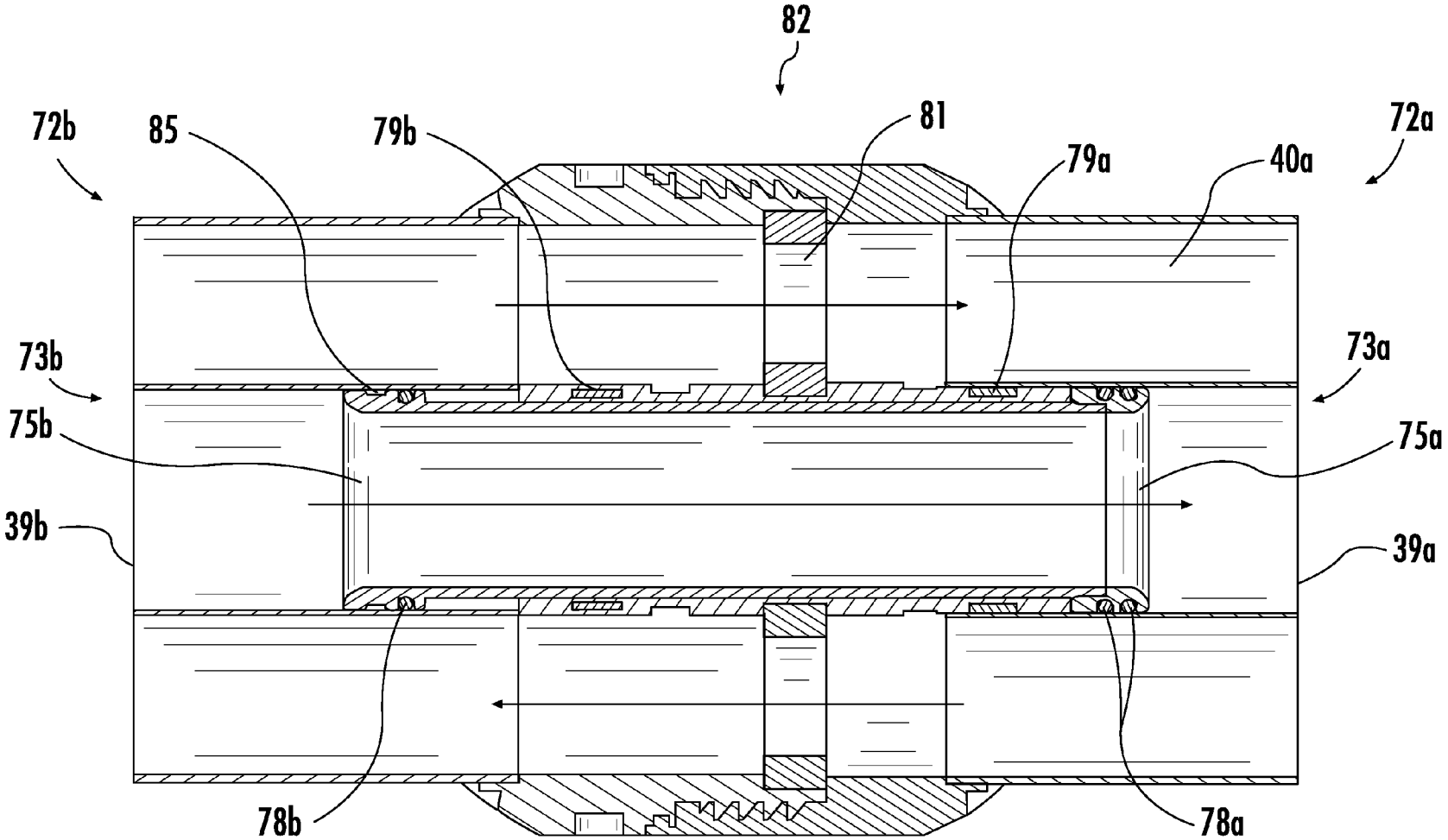
FIG. 9 is a cross-sectional view of the transmission line segment coupler of FIG. 7.

As shown in FIG. 9, the bullet 70 advantageously allows various flow options, including internal flow in one direction, with an external return flow in the opposite direction through the annulus at the well head. Moreover, as shown in FIG. 10, the sealed, uniform, and streamlined internal surface of the inner tubular bearing body 74 allows for flow with relatively small interruption.

A related method for making the bullet 70 is now briefly described. The method includes forming the outer tubular bearing body 71, forming the inner tubular bearing body 74 which is configured to slidably move within the outer tubular bearing body to define a linear bearing therewith, and positioning the inner tubular bearing body within the outer tubular bearing body. More particularly, the second end 75*b* may be crimped to the inner conductor 39*b* of a coaxial transmission line segment at the factory, and the outer tubular bearing body 74 positioned on the inner tubular bearing body 71. The first end 75*a* is then screwed on to (or otherwise attached) to the medial portion 76 to secure the assembled bullet 70 to the coaxial transmission line segment 72*b*. The completed assembly may then be shipped to the well site, where it is coupled end-to-end with other similar segments to define the transmission line 38 to be fed down into the wellbore 33.

Figure 13:
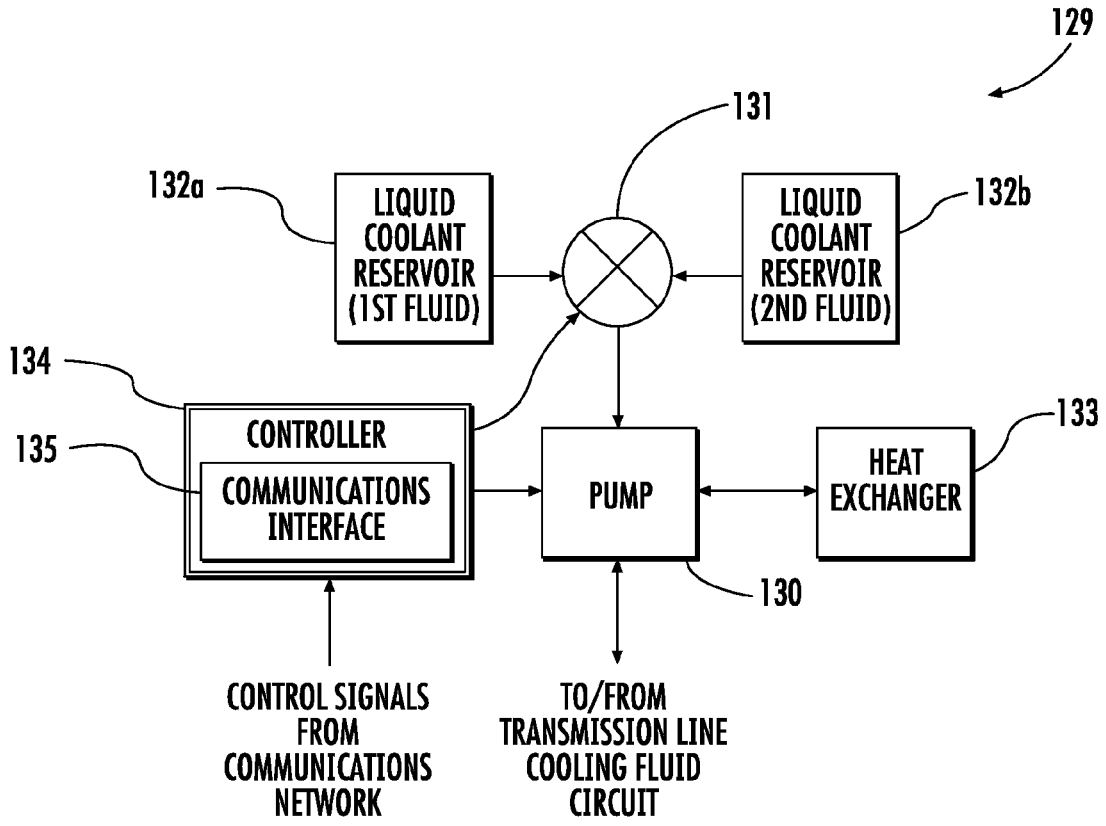
FIG. 13 is a schematic block diagram of an exemplary fluid source configuration for the apparatus of FIG. 1.
Figure 16:
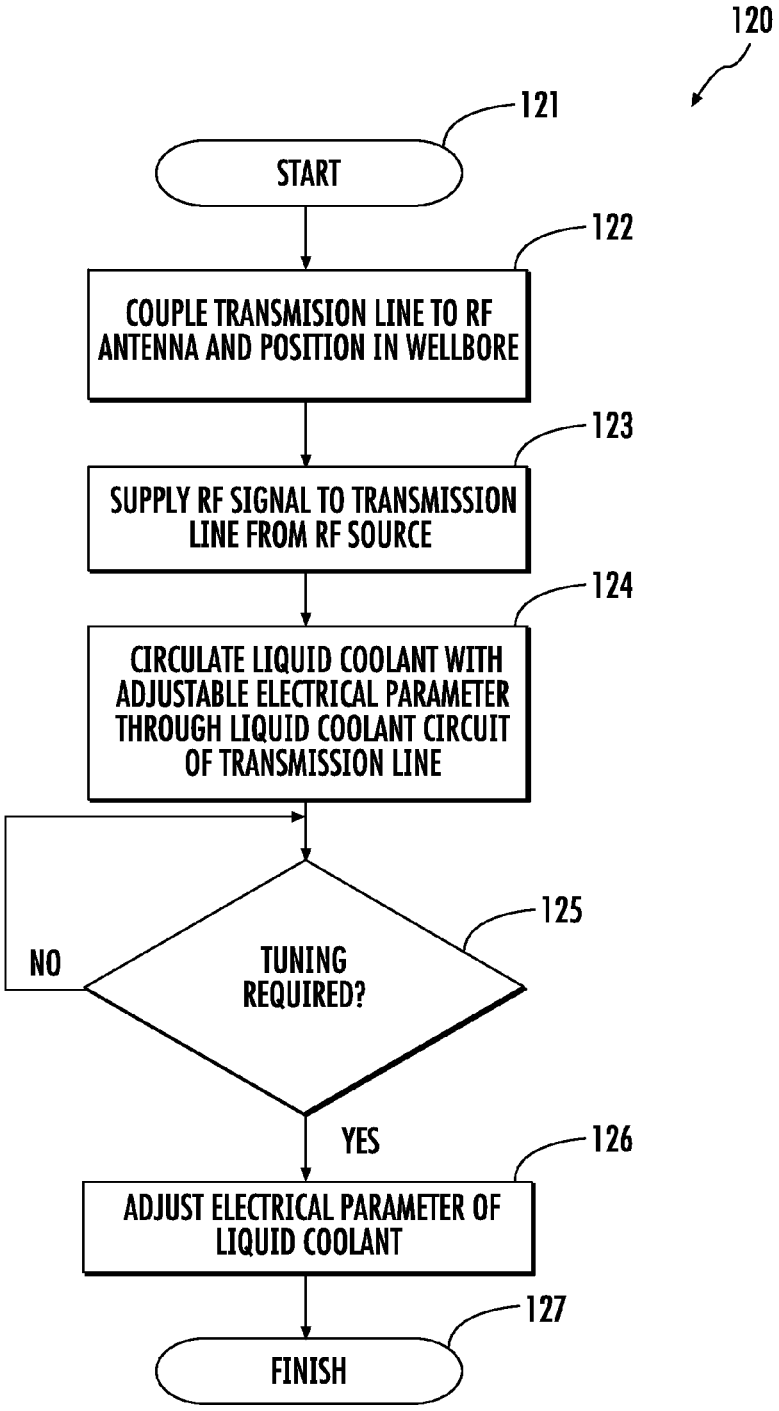

Turning now additionally to FIGS. 13 and 16, another advantageous approach to provide additional RF tuning (or independent RF tuning) based upon the cooling fluid circulating through the transmission line 38 is now described. By way of background, in order to heat surrounding media and more easily facilitate extraction of a hydrocarbon resource (e.g., petroleum), a relatively high-power antenna is deployed underground in proximity to the hydrocarbon resource 31, as noted above. As the geological formation is heated, its complex electrical permittivity changes with time, which means the input impedance of the RF antenna 35 used to heat the formation also changes with time. To efficiently deliver energy from the RF antenna 35 to the surrounding medium, the characteristic impedance of the transmission line 38 should closely match the input impedance of the RF antenna.

In accordance with the present embodiment, relative electric permittivity of circulating dielectric fluids used to cool the transmission line 38 may be tailored or adjusted such that the characteristic impedance of the coaxial transmission line more closely matches the input impedance of the RF antenna 35 as it changes with time. This approach may be particularly beneficial in that the transmission line 38 and the RF antenna 35 are generally considered inaccessible once deployed in the wellbore 33. Moreover, impedance matching units using discrete circuit elements may be difficult to implement in a wellbore application because of low frequencies and high power levels. Further, while the frequency of the RF signal may be varied to change the imaginary part of the input impedance (i.e., reactance), this does little to help better match the real part (i.e., resistance) of the input impedance to the characteristic impedance of the transmission line 38.

Accordingly, a liquid coolant source 129 is advantageously configured to be coupled to the transmission line 38 and to provide a liquid coolant through the liquid coolant circuit having an electrical parameter (e.g., a dielectric constant) that is adjustable. The liquid coolant source 129 includes a liquid pump 130 and a heat exchanger 133 coupled in fluid communication therewith. The pump 130 advantageously circulates the liquid coolant through the liquid coolant circuit of the transmission line 138 and the heat exchanger 133 to cool the transmission line so that it may maintain desired operating characteristics, as noted above. Various types of liquid heat exchanger arrangements may be used, as will be appreciated by those skilled in the art.

Furthermore, the liquid coolant source 129 also includes a plurality of liquid coolant reservoirs 132*a*, 132*b* each for a respective different liquid coolant. Dielectric liquid coolants such as those described above (e.g., mineral oil, silicon oil, etc.) may be used. More particularly, each liquid cooling fluid may have different values of the electrical parameter. Furthermore, a mixer 131 is coupled with the pump 130 and the liquid coolant reservoirs 132*a*, 132*b* for adjustably mixing the different liquid coolants to adjust the electrical parameter. The liquid coolants may be miscible in some embodiments. That is, a mixture of two or more miscible dielectric fluids having different dielectric constants may be mixed to provide continuous impedance matching to the changing RF antenna 35 impedance.

In some embodiments, a controller 134 may be coupled to the mixer 131 (as well as the pump 130), which is used to the control the coolant fluid mixing based upon a changing impedance of the transmission line 38. That is, the controller 134 is configured to measure an impedance of the transmission line 38 and RF antenna as they change over the course of the heating cycle, and change the cooling fluid mixture accordingly to provide the appropriate electrical parameter to change the impedance for enhanced efficiencies. In some embodiments, the controller 134 may optionally include a communications interface 135 configured to provide remote access via a communications network (e.g., cellular, Internet, etc.). This may advantageously allow for remote monitoring and changing of the coolant fluid mixture, which may be particularly advantageous for remote installations that are difficult to reach. Moreover, this may also allow for remote monitoring of other operational parameters of the well, including pressure, temperature, available fluid levels, etc., in addition to RF operating characteristics.

In particular, the characteristic impedance of the coaxial transmission line 38 may be changed by varying the dielectric constant of the cooling fluid used inside the transmission line. The dielectric constant of the fluids may be changed in discrete steps, using readily available fluids, or in a continuous manner by deploying custom fluids with arbitrary dielectric constants. Typical values of dielectric constant range from about Er=2 to 5, and more particularly about 2.1 to 4.5, which may result in characteristic impedances from about 15 ohms to 30 Ohms, given the typical wellbore dimensions noted above. More specifically, for a coaxial transmission line having an inner conductor with a diameter d and an outer conductor with a diameter D, with the inner conductor filled with a fluid of a given Er, the characteristic impedance $Z_0$ of the coaxial transmission line is as follows:

$$Z_0 = \frac{1}{2\pi}\sqrt{\frac{\mu}{\epsilon}}\ln\frac{D}{d} \approx \frac{138\Omega}{\sqrt{\epsilon_r}}\log_{10}\frac{D}{d}$$

Accordingly, the above-described approach may advantageously provide for reduced RF signal loss, and therefore higher efficiency to the overall system. This approach may also provide for a relatively high voltage breakdown enhancement inside both the RF antenna 35 and the coaxial transmission line 38. In addition, the coolant mixture may also provide pressure balance to thereby allow the RF antenna 35 to be maintained at the given subterranean pressure. The dielectric cooling fluid mixture also provides a cooling path to cool the transmission line 38, and optionally to the RF antenna 35 and the transducer casing (if used).

A related method for heating a hydrocarbon resource in a subterranean formation having a wellbore extending therein is now described with reference to FIG. 16. Beginning at Block 121, the method includes coupling an RF transmission line to an RF antenna and positioning the RF transmission line and RF antenna within the wellbore, at Block 122, where the RF transmission line defines a liquid coolant circuit therethrough. The method further includes supplying an RF signal to the transmission lined from an RF source, and circulating a liquid coolant having an electrical parameter that is adjustable from a liquid coolant source through the liquid coolant circuit, at Blocks 123 and 124. As additional tuning is required, the electrical parameter of the liquid coolant may be adjusted appropriately (Blocks 125-126), as discussed further above, which concludes the method illustrated in FIG. 16 (Block 127).

It should be noted that the electrical parameter of a dielectric fluid used in the above-described liquid balun 45 or liquid tuning sections 60 may similarly be changed or adjusted to advantageously change the operating characteristics of the liquid balun or liquid tuning sections. That is, varying the dielectric properties of the fluids is another approach to tuning the center frequency of the liquid balun 45 or the liquid tuning sections 60. Moreover, dielectric fluids with different electrical parameters may be used in different components (e.g., cooling circuit fluid, balun fluid, or tuning segment fluid).

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for heating a hydrocarbon resource in a subterranean formation having a wellbore extending therein, the apparatus comprising:

a radio frequency (RF) source;

an RF antenna configured to be positioned within the wellbore;

a coaxial RF transmission line configured to be positioned within the wellbore and couple said RF source to said RF antenna, said coaxial RF transmission line comprising an inner tubular conductor and an outer tubular conductor surrounding said inner tubular conductor, the inner tubular conductor defining a liquid coolant circuit therethrough;

a pair of spaced apart liquid blocking plugs between the inner and outer tubular conductors and defining a liquid tuning section therebetween for a liquid dielectric; and a liquid coolant source configured to be coupled to said coaxial RF transmission line and to provide a liquid coolant through the liquid coolant circuit and with the liquid coolant having an electrical parameter that is adjustable.

2. The apparatus of claim 1 wherein said liquid coolant source further comprises a liquid pump and a heat exchanger coupled in fluid communication therewith.

3. The apparatus of claim 1 wherein said liquid coolant source comprises:

a plurality of liquid coolant reservoirs for respective different liquid coolants having different values of the electrical parameter; and a mixer for adjustably mixing the different liquid coolants to adjust the electrical parameter.

4. The apparatus of claim 3 further comprising a controller coupled to said mixer.

5. The apparatus of claim 4 wherein said controller is responsive to a changing impedance of said coaxial transmission line.

6. The apparatus of claim 1 wherein said controller comprises a communications interface configured to provide remote access via a communications network.

7. The apparatus of claim 1 wherein the electrical parameter that is adjustable comprises a dielectric constant.

8. The apparatus of claim 1 wherein the liquid coolant comprises at least one of a mineral oil, a silicon oil, and an ester-based oil.

9. An apparatus for heating a hydrocarbon resource in a subterranean formation having a wellbore extending therein, the apparatus comprising:

a radio frequency (RF) source;

an RF antenna configured to be positioned within the wellbore;

a coaxial RF transmission line configured to be positioned within the wellbore and couple said RF source to said RF antenna, said coaxial RF transmission line comprising an inner tubular conductor and an outer tubular conductor surrounding said inner tubular conductor, the inner tubular conductor defining a liquid coolant circuit therethrough;

a pair of spaced apart liquid blocking plugs between the inner and outer tubular conductors and defining a liquid tuning section therebetween for a liquid dielectric; and a liquid coolant source configured to be coupled to said coaxial RF transmission line and to provide a liquid coolant through the liquid coolant circuit having an electrical parameter that is adjustable, said liquid coolant source comprising a liquid pump and a heat exchanger coupled in fluid communication therewith, a plurality of liquid coolant reservoirs for respective different liquid coolants having different values of the electrical parameter, and a mixer in fluid communication with said liquid pump, heat exchange, and liquid coolant reservoirs configured to adjustably mix the different liquid coolants to adjust the electrical parameter.

10. The apparatus of claim 9 further comprising a controller coupled to said mixer.

11. The apparatus of claim 10 wherein said controller is responsive to a changing impedance of said coaxial RF transmission line.

12. The apparatus of claim 9 wherein said controller comprises a communications interface configured to provide remote access via a communications network.

13. The apparatus of claim 9 wherein the electrical parameter that is adjustable comprises a dielectric constant.

14. A method for heating a hydrocarbon resource in a subterranean formation having a wellbore extending therein, the apparatus comprising:

coupling a coaxial radio frequency (RF) transmission line to an RF antenna and positioning the coaxial RF transmission line and RF antenna within the wellbore, the RF transmission line comprising an inner tubular conductor and an outer tubular conductor surrounding said inner tubular conductor, the inner tubular conductor defining a liquid coolant circuit therethrough, and the coaxial RF transmission line having a pair of spaced apart liquid blocking plugs between the inner and outer tubular conductors and defining a liquid tuning section therebetween for a liquid dielectric;

supplying an RF signal to the coaxial RF transmission line from an RF source; and circulating a liquid coolant having an electrical parameter that is adjustable from a liquid coolant source through the liquid coolant circuit.

15. The method of claim 14 wherein circulating further comprises using a liquid pump to circulate the liquid coolant through the liquid cooling circuit and a heat exchanger coupled in fluid communication therewith.

16. The method of claim 14 wherein circulating further comprises mixing a plurality of different liquid coolants from respective different liquid coolant reservoirs each having different values of the electrical parameter.

17. The method of claim 14 further comprising adjusting the electrical parameter of the liquid coolant responsive to a changing impedance of the transmission line.

18. The method of claim 14 wherein the electrical parameter that is adjustable comprises a dielectric constant.

* * * * *